US006102281A

United States Patent [19]

Lafferty et al.

[11] Patent Number: 6,102,281

[45] Date of Patent: Aug. 15, 2000

[54] PARTIALLY-SHIELD MICROWAVE HEATING TRAY

[75] Inventors: Terrence P. Lafferty, Milford; James L. Capo, Middletown, both of Ohio; Michael P. Kessel, Weston, Wis.

[73] Assignee: Graphic Packaging Corporation, Golden, Colo.

[21] Appl. No.: 08/969,486

[22] Filed: Nov. 13, 1997

[51] Int. Cl.[7] ..... B65D 5/02

[52] U.S. Cl. ..... 229/185.1; 229/5.82; 229/903; 426/107; 219/729

[58] Field of Search ..... 219/729, 730; 426/107; 229/5.82, 906, 903, 902, 182.1, 185.1

[56] References Cited

U.S. PATENT DOCUMENTS

| | | | |
|---|---|---|---|
| 1,128,701 | 2/1915 | Miller | 229/185.1 |
| 3,640,209 | 2/1972 | Wilson | 229/5.82 X |
| 3,865,301 | 2/1975 | Pothier et al. | 229/5.82 X |
| 4,204,105 | 5/1980 | Levekis et al. | 426/107 X |
| 4,351,997 | 9/1982 | Mattison et al. | 219/10.55 E |
| 4,626,641 | 12/1986 | Brown | 426/107 X |
| 4,801,774 | 1/1989 | Hart | 219/729 X |
| 4,865,921 | 9/1989 | Hollenberg et al. | 426/107 X |
| 5,288,962 | 2/1994 | Lorence et al. | 219/729 |
| 5,370,883 | 12/1994 | Saunier | 426/107 |
| 5,585,027 | 12/1996 | Young | 219/729 X |
| 5,718,370 | 2/1998 | Lafferty et al. | 229/120.18 |

FOREIGN PATENT DOCUMENTS

| | | | |
|---|---|---|---|
| 1593523 | 7/1981 | United Kingdom | H05B 6/64 |
| 2112257 | 7/1983 | United Kingdom | H05B 6/64 |

*Primary Examiner*—Stephen P. Garbe
*Assistant Examiner*—Tri M. Mai
*Attorney, Agent, or Firm*—Dorsey & Whitney LLP

[57] ABSTRACT

A partially-shielded paperboard tray for heating food in a microwave oven is made from a unitary blank having two sections hingedly joined at a common edge. One section, which forms the bottom stratum of the tray, has a layer of aluminum foil for shielding food along the peripheral wall of the tray from microwave radiation, but the section also has a large aperture to allow the radiation to heat the center of food placed over the aperture. The other section of the blank, which forms the top stratum of the tray, is transparent to microwave radiation and provides an imperforate food-contact surface for retaining food in the tray.

7 Claims, 2 Drawing Sheets

PARTIALLY-SHIELD MICROWAVE HEATING TRAY

BACKGROUND OF THE INVENTION

This invention is an improved paperboard tray for heating, in a microwave oven, food packaged in the tray.

Food processors commonly package food, particularly frozen food, in a paperboard tray that is intended to be placed in a microwave oven to heat the food. When the tray is totally transparent to microwave energy, the peripheral edges of the food tend to overheat while the center of the food remains relatively cool. It is known that the food may be heated more uniformly by including a material opaque to microwave radiation, such as aluminum foil, in the peripheral wall of the tray. For example, British patents 1,593,523 and 2,112,257 and U.S. Pat. No. 4,351,997 disclose such trays wherein the trays are formed by pressing. However, manufacturing trays by pressing requires a substantial capital investment for tooling, which may not be economical for low volume applications. U.S. Pat. No. 4,626,641 discloses a microwave transparent tray that fits snugly into a tray made by simply folding and gluing a blank made from a laminate of paperboard and aluminum foil wherein a hole is cut in the aluminum layer to allow microwave energy to penetrate the bottom of the tray. U.S. Pat. No. 5,370,883 discloses essentially the same tray. However, the trays disclosed in these patents require two different components to manufacture. This invention provides a partially-shielded tray that is made by folding a unitary blank.

SUMMARY OF THE INVENTION

The tray of this invention has a top section and a bottom section that are hingedly connected along a common edge and that are formed from a unitary blank. The bottom section comprises a laminate of a layer of material transparent to microwave radiation, preferably paperboard, and a layer of material opaque to microwave radiation, preferably aluminum foil. The bottom section has a base panel and a plurality of side panels extending upwardly from the base panel, which has an aperture in the layer of material opaque to microwave radiation. The top section, which conforms to and is nested inside the bottom section, comprises a layer of microwave transparent material, preferably paperboard, and has a base panel and a plurality of side panels extending upwardly from the base panel. The bottom section shields product, such as food, placed in the tray from microwave radiation, except the aperture in the base panel allows the radiation to pass through to heat the center of the food. The top section provides a food-contact surface for retaining the food in the tray. In a preferred embodiment a flap extending from a side panel of the top section is folded over the top edge of a side panel of the bottom section and adhered thereto to reinforce the edge and to conceal the layer of material opaque to microwave radiation. An advantage of the invention is that the tray can be made from a single blank which is simply folded and glued rather than pressed.

DESCRIPTION OF THE PREFERRED EMBODIMENTS

Figure 1:
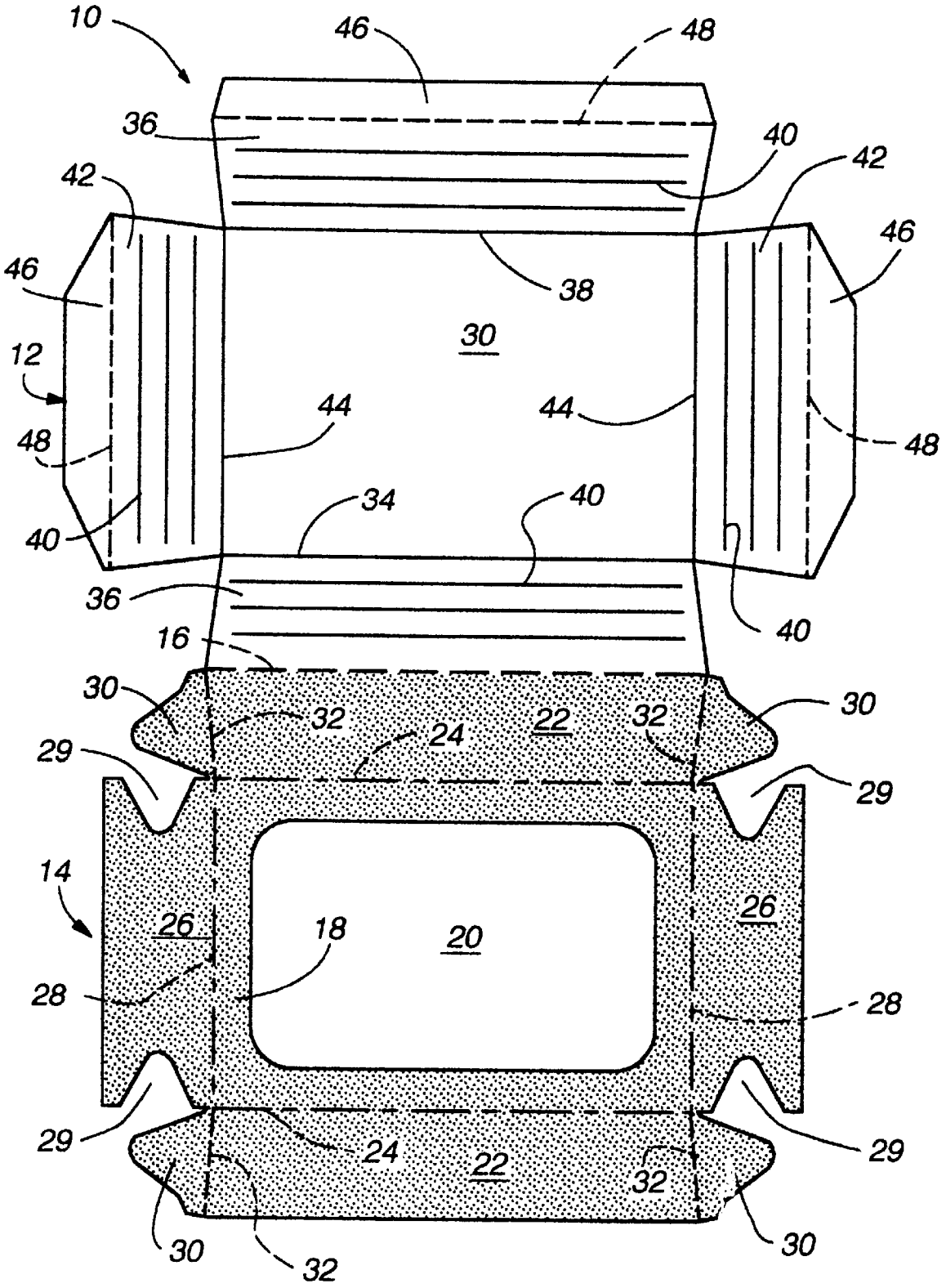
FIG. 1 is a plan view of the blank from which the tray of this invention is formed.

Referring to FIG. 1, the tray of this invention is formed from a unitary blank 10 having a top section 12 and a bottom section 14 that are hingedly connected along fold line 16.

The bottom section 14 has a base panel 18 having an aperture 20 that is made by cutting out a portion of the base panel 18. A side panel 22 is hingedly connected to each longitudinal side of the base panel 18 along a fold line 24. An end panel 26 is hingedly connected to each transverse side of the base panel 18 along a fold line 28. A recess 29 is preferrably present at each end of each end panel 26. A glue tab 30 is hingedly connected along a fold line 32 to each end of each side panel 22. (The glue tabs could extend from the end panels, but that embodiment is not preferred.)

The area of the aperture 20 preferably represents from about 40 to 80 percent of the total area of the base panel (i.e., the area before the aperture is cut out). The shape of the aperture preferably conforms to the shape of the base panel. For example, if the base panel is a rectangle, the aperture is also preferably a rectangle, as shown in FIG. 1. When the food packaged in the tray is a single dish, the center of the aperture preferably coincides with the center of the base of the tray. When the food consists of more than one dish, the aperture is preferably centered under the dish requiring the most heating.

The top section 12 has a base panel 30 that conforms to the dimensions of the base panel 20 of the bottom section 14, except the base panel 30 of the top section is imperforate. A side panel 32 is hingedly connected along a fold line 34 to a longitudinal side of the base panel 30 and is hingedly connected along the fold line 16 to a side panel 22 of the bottom section 14. Another side panel 36 is hingedly connected along fold line 38 to the other (opposing) longitudinal side of the base panel 30. The two side panels 32, 36 of the top section substantially conform to the two side panels 22 of the bottom section. An end panel 42 is hingedly connected to each transverse side of the base panel 30 along a fold line 44. A flap 46 is hingedly connected along a fold line 48 to each end panel 42 and to the side panel 36 that is not hingedly connected to the side panel 22 of the bottom section 14. The two side panels and the two end panels of the top section preferably have a plurality of score lines 40 (only one of which is designated as 40 in each panel) extending parallel to the longitudinal axis of each panel for the purpose of modifying the rigidity of the panels. However, the score lines 40 are not essential and may be omitted if desired.

The blank 10 is made by strip laminating a continuous length of aluminum foil to a continuous length of paperboard, with the aluminum foil extending from one edge of the paperboard to about the longitudinal centerline of the paperboard, and then die cutting the blank 10 and others like it from the laminated paperboard. The aluminum foil is the surface layer of the bottom section 14 shown in FIG. 1, and is represented by stippling in FIG. 1. Other material opaque to microwave radiation can be substituted for the aluminum foil. The blank 10 preferably contains a layer of plastic film as the surface layer of the blank on the reverse side of the blank (the side to which the aluminum foil is laminated being the obverse side shown in FIG. 1). The layer of plastic film may be applied to the continuous length of paperboard from which the blank 10 is made by adhesive lamination, extrusion coating, or application of liquid (e.g. aqueous) coating. The plastic film, which should be able to withstand the temperatures encountered in a microwave oven, is preferably a polyester film. The tray of this invention may be used in a conventional oven as well as a microwave oven, if desired.

Figure 2:
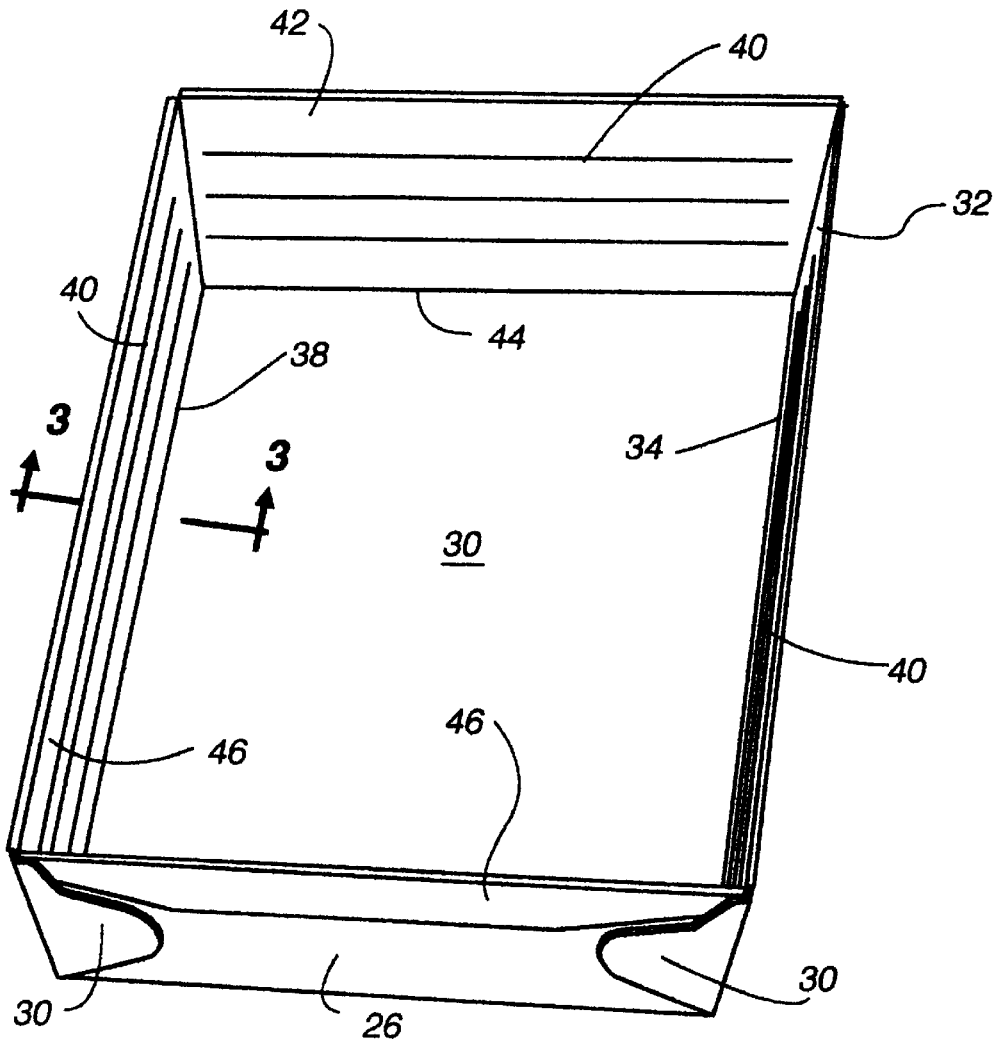
FIG. 2 is a perspective view of the tray.

The tray of the invention, which is shown in FIG. 2, is formed by rotating the top section 12 about fold line 16 180 degrees as indicated by the curved arrow so that the top section 12 lies flat atop the bottom section 14. Before the top section is rotated, a sufficient amount of adhesive (not shown) is applied to the base panel 18, the side panels 22 and the end panels 26 of the bottom section to glue the panels to the corresponding panels of the top section. An adhesive (not shown) is also applied to the obverse surface of the flaps 46 (the surface shown in FIG. 1). The flaps 46 are then rotated down 180 degrees so that the flaps are glued to the exterior surface of the tray. The flaps 46 form a reinforcing rim around three top edges of the tray and also cover the edges. Although the flaps 46 perform a useful function, they are not essential and may be omitted if desired.

The side panels 22, 32, 36 and end panels 26, 42 are then rotated up about their respective fold lines until the edges of adjacent side panels and end panels abut to form the peripheral wall of the tray, which preferably flares out so the trays can be nested. An adhesive (not shown) is applied to each glue tab 30 to glue the glue tabs to the end panels 42 of the top section, thereby completing formation of the tray. The recesses 29 in the end panels 26 of the bottom section allow the glue tabs to contact and become adhesively joined to the end panels 42 of the top section. The tray does not leak when used as intended. However, the corners of the tray may be webbed if desired.

Figure 3:
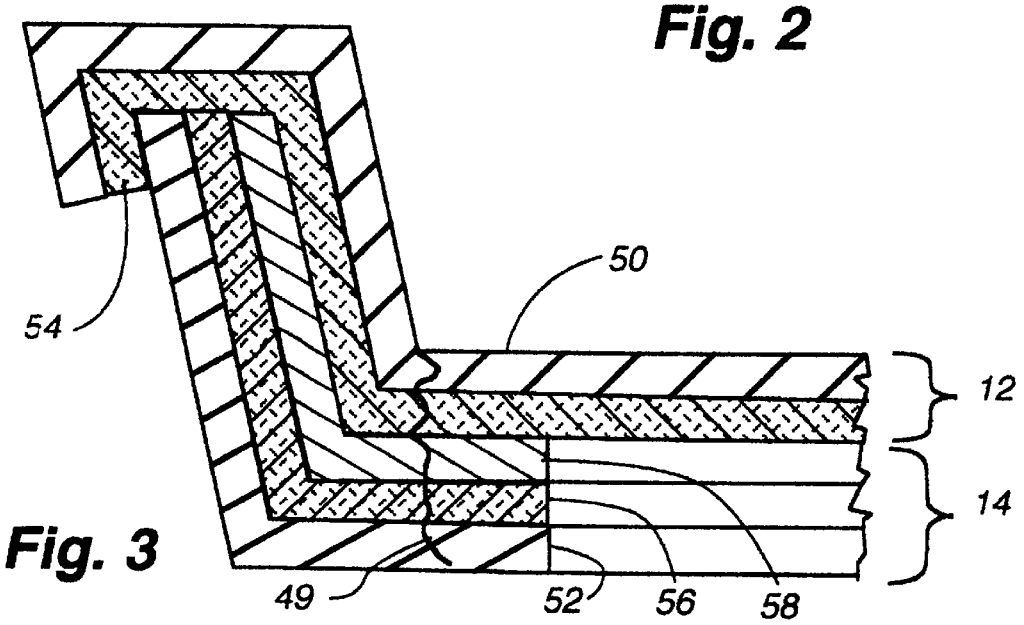
FIG. 3 is a partial sectional view of the base of the tray taken along line 3—3 of FIG. 2.

FIG. 3 shows a partial cross section of the tray to illustrate the structure of the tray. The interior surface layer 50 of the tray, as well as the exterior surface layer 52, is a layer of plastic film as described above. The interior surface layer 50 is adjacent to a layer of paperboard 54, and together the two layers form the top section 12 of the blank 10. The exterior surface layer 52 is adjacent to a layer of paperboard 56 laminated to a layer of aluminum foil 58. The layers 52, 56, and 58 form the bottom section 14 of the blank 10. If desired, the surface of each paperboard layer, especially layer 56, in contact with plastic film can be printed with graphics or ornamental designs before the plastic film is applied to the paperboard surface. The layer of aluminum foil 58 is sandwiched between layers of paperboard 54, 56. Accordingly, the planar surface of the foil is not seen by the consumer, which is desirable since some consumers may be reluctant to place containers containing metal into a microwave oven. Similarly, the flaps 46 conceal the edges of the aluminum foil except the edge that is concealed by the fold line 16. The thicknesses of the layers shown in FIG. 3 are exaggerated to better illustrate the invention.

The trays of this invention are intended to be supplied as a stack of nested trays to a food processor, which fills the trays with food. To reduce the risk of arcing, the food preferably contacts all interior surfaces of each tray. Each filled tray is then normally frozen and inserted into an outer carton which is sealed. The carton is opened by the consumer, who places the tray in a microwave oven to heat the food. An advantage of this invention is that the food is heated uniformly in the tray, which is disposable. This advantage is especially applicable to trays containing a relatively large quantity of food, such as between about 500 and 2500 grams, because such large quantities of food are difficult to heat uniformly in a tray that is not partially shielded like the tray of this invention.

What is claimed is:

1. A tray, for heating by microwave energy food placed in the tray, said tray comprising (i) a bottom section and (ii) a top section, the bottom section (i) comprising a laminate of a layer of paperboard and a layer of material opaque to microwave radiation, the bottom section having a base panel and a plurality of side panels extending upwardly from the base panel, the base panel having an aperture in the layer of material opaque to microwave radiation, and the top section (ii) comprising a layer of paperboard having an imperforate base panel and a plurality of side panels extending upwardly from the base panel, with one of the side panels of the top section having a flap that extends from the side panel and is folded over the top edge of the corresponding side panel of the bottom section and adhered thereto, wherein the top section is nested inside the bottom section and adhered thereto, and wherein the top section and the bottom section are hingedly connected along a common edge and formed from a unitary blank.

2. A unitary blank for forming a tray for heating by microwave energy food placed in the tray, said unitary blank comprising (i) a bottom section and (ii) a top section, the bottom section (i) comprising a laminate of a layer of paperboard and a layer of material opaque to microwave radiation, the bottom section having a base panel, the base panel having an aperture in the layer of material opaque to microwave radiation, a pair of side panels hingedly connected to the base panel along fold lines, a pair of end panels hingedly connected to the base panel along fold lines, a glue tab hingedly connected along a fold line to each end of each side panel, and the top section (ii) comprising a layer of paperboard having an imperforate base panel, a pair of opposed side panels hingedly connected to the base panel along fold lines, a pair of opposed end panels hingedly connected to the base panel along fold lines, wherein the top section and the bottom section are hingedly connected along a fold line.

3. A blank according to claim 2, wherein the layer of material opaque to microwave radiation is aluminum foil.

4. A blank according to claim 2, wherein the total area of the aperture represents from about 40 to 80 percent of the total area of the base panel of the bottom section.

5. A blank according to claim 2, wherein a flap extends from a side panel or end panel of the top section.

6. A blank according to claim 2, wherein each end of each end panel of the bottom section has a recess to allow the glue tabs to be glued to the end panels of the top section.

7. A blank according to claim 2, wherein a panel of the top section has score lines to modify the rigidity of the panel.

* * * * *